US005408708A

United States Patent [19]

Mathis

[11] Patent Number: 5,408,708

[45] Date of Patent: Apr. 25, 1995

[54] FLOW-CONTROL FOR A PUMP

[75] Inventor: Cleo D. Mathis, South El Monte, Calif.

[73] Assignee: Vico Products Manufacturing Co., Inc., South El Monte, Calif.

[21] Appl. No.: 172,382

[22] Filed: Dec. 23, 1993

Related U.S. Application Data

[62] Division of Ser. No. 604,237, Oct. 29, 1993, abandoned.

[51] Int. Cl.[6] ..... A61H 33/02

[52] U.S. Cl. ..... 4/541.4; 4/541.1

[58] Field of Search ..... 4/541.1, 541.2, 541.3, 4/541.4, 541.5; 415/146, 148, 150

[56] References Cited

U.S. PATENT DOCUMENTS

| | | | |
|---|---|---|---|
| 1,482,405 | 2/1924 | Moody | 415/150 |
| 3,396,412 | 8/1968 | Francom | 4/541.4 |
| 3,625,628 | 12/1971 | Byrns | 415/150 |
| 3,635,580 | 1/1972 | Richardson | 415/150 |
| 3,698,832 | 10/1972 | Price | 415/148 |
| 4,586,204 | 5/1986 | Daniels | 4/541.4 |
| 4,780,917 | 11/1988 | Hancock | 4/541.2 |
| 4,844,333 | 7/1989 | Davis et al. | 4/541.1 X |

FOREIGN PATENT DOCUMENTS

| | | | |
|---|---|---|---|
| 3408217 | 9/1985 | Germany | 4/541.3 |
| 3820350 | 12/1989 | Germany | 4/541.3 |
| 9001917 | 3/1990 | WIPO . | |

*Primary Examiner*—Robert M. Fetsuga
*Attorney, Agent, or Firm*—Cushman Darby & Cushman

[57] ABSTRACT

A flow-regulating valve is located in the outlet of the housing of a centrifugal pump instead of in downstream piping, to regulate the flow from the pump without the usual acoustic disturbance caused by flow. The arrangement is especially adapted for hydro-therapeutic installations, such as a spa, hot tub, whirlpool bath or the like. The valve is operated by a control conveniently accessible to the occupant of the hydro-therapeutic installation. The control can be in the form of a knob connected to the valve by flexible cable or the like or in the form of a single push-button which controls both the electric motor for the pump and an electric motor which operates the valve.

10 Claims, 4 Drawing Sheets

26
34
74
22
10
22
20
76
12
16
14
20
20
30
22
28
18
22
20

FLOW-CONTROL FOR A PUMP

This is a division of application No. 07/604,237, filed Oct. 29, 1993, abandoned.

FIELD OF THE INVENTION

This invention relates to improvements in controlling or regulating the flow from a liquid pump. More particularly, it relates to regulating the flow from a liquid pump supplying water to hydro-therapeutic apparatus, such as a spa, hot tub or Jacuzzi, although it will be understood that other applications of the invention are possible and desirable.

BACKGROUND OF THE INVENTION

Hydro-therapeutic treatment apparatus, such as spas, hot tubs and whirlpool baths, usually involves a tub having nozzles in its side-walls to which water is supplied by an electrically powered centrifugal pump. The water in the tub then is recirculated back to the inlet of the pump. Manifestly, it is desirable for an occupant of the tub to be able to regulate the velocity or flow of the water exiting, sometimes as jets, from the various nozzles mounted in the sides of the tub. In the past this has been accomplished by controlling the motor of the pump to provide a high or a low speed with commensurate flow, i.e. by a control which changes the motor windings. Desirable continuously variable or incremental regulation is not provided with such a control, however, because such a motor would be prohibitively expensive for hydro-therapeutic treatment apparatus, especially for a spa, hot tub or a whirlpool bath. It also has been suggested to continuously regulate the flow by a flow control valve mounted between the pump and the lines or piping supplying the water to the tub nozzles, such as disclosed in the U.S. Pat. Nos. to Friend, 2,772,421, Dec. 4, 1956, Kline, 4,110,852, Sep. 5, 1978, and Henkin et al, 4,679,258, Jul. 14, 1987. It has been found, however, that such a flow control valve mounted between the pump outlet and the water supply lines to the nozzles causes a considerable amount of noise when the pump is in operation. Since the valve is usually mounted adjacent the tub, such noise is disturbing to an occupant of the tub. Moreover, the valve operating knob or handle usually has been in a location not readily accessible to an occupant of the tub, necessitating getting out to operate the valve and regulate the flow.

OBJECT OF THE INVENTION

Accordingly, it is an object of this invention to provide improved means for continuously regulating the flow of liquid from a centrifugal pump which is simple, inexpensive, space-saving, labor-saving and noiseless when the pump is in operation.

It is another object of this invention to apply such improved means to hydro-therapeutic apparatus with a regulating control that is readily accessible to an occupant of the apparatus.

It is a further object of this invention to provide hydro-therapeutic apparatus with a single manually-manipulable control for both starting and stopping the pump supplying water to tub nozzles and regulating the flow of water from the pump.

BRIEF SUMMARY OF THE INVENTION

The foregoing objects are accomplished by locating a flow-regulating means in the outlet of a centrifugal pump which is an actual part of the pump housing, and wherein these means are controlled. This may be done by a flexible cable or rod extending to a manually-operable knob readily accessible to the occupant of the therapeutic treatment apparatus, such as a spa, whirlpool bath or a hot tub. The flow-regulating means arrangement can also be in the form of an electric motor with the switch control for the motor not only accessibly located to an occupant of the tub but also arranged to turn the motor for the pump off and on.

Other objects and advantages of the invention will become evident from the following detailed description and accompanying drawings in which:

DETAILED DESCRIPTION OF THE INVENTION

Figure 1:
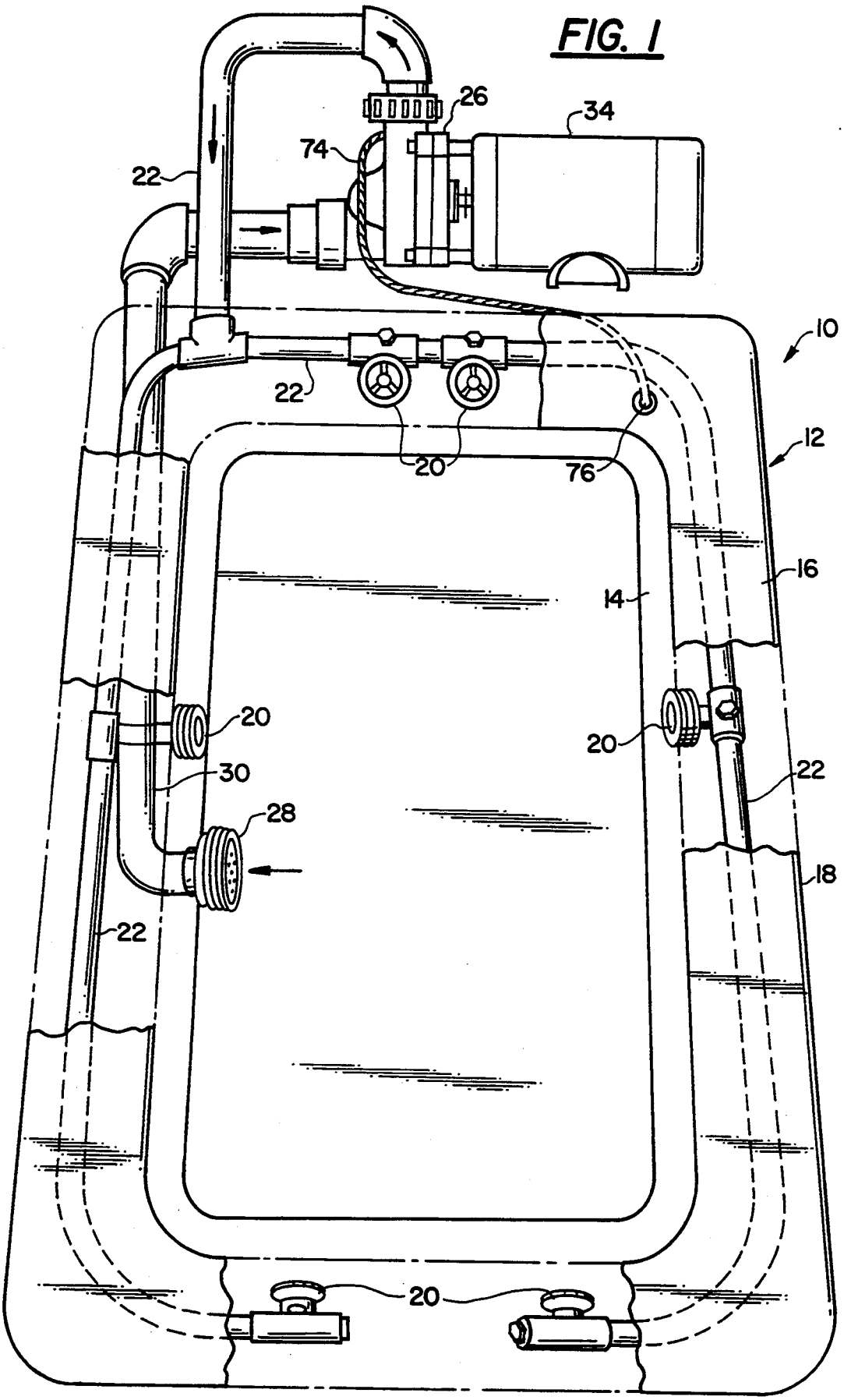
FIG. 1 is a perspective view of a whirlpool bath with parts broken away to show the piping system, pump and flow-regulating control embodying this invention.

As shown in the drawings, there is shown an illustrative application of this invention to a conventional whirlpool bath 10 having the usual tub 12 provided with side walls 14, a flat extended rim or lip 16, and enclosure walls 18 depending from the outer periphery of the rim. The tub 12 has nozzles 20 mounted in the side walls 14 to direct streams or jets of water into the tub. The nozzles 20 are supplied with water through supply piping 22 connected to the outlet 24 of a centrifugal pump 26. The system also includes a suction head 28 in the tub 12 connected to a return flow pipe 30 connected to the inlet 32 of the pump 26. The pump 26 usually is driven by an electric motor 34.

Figure 2:
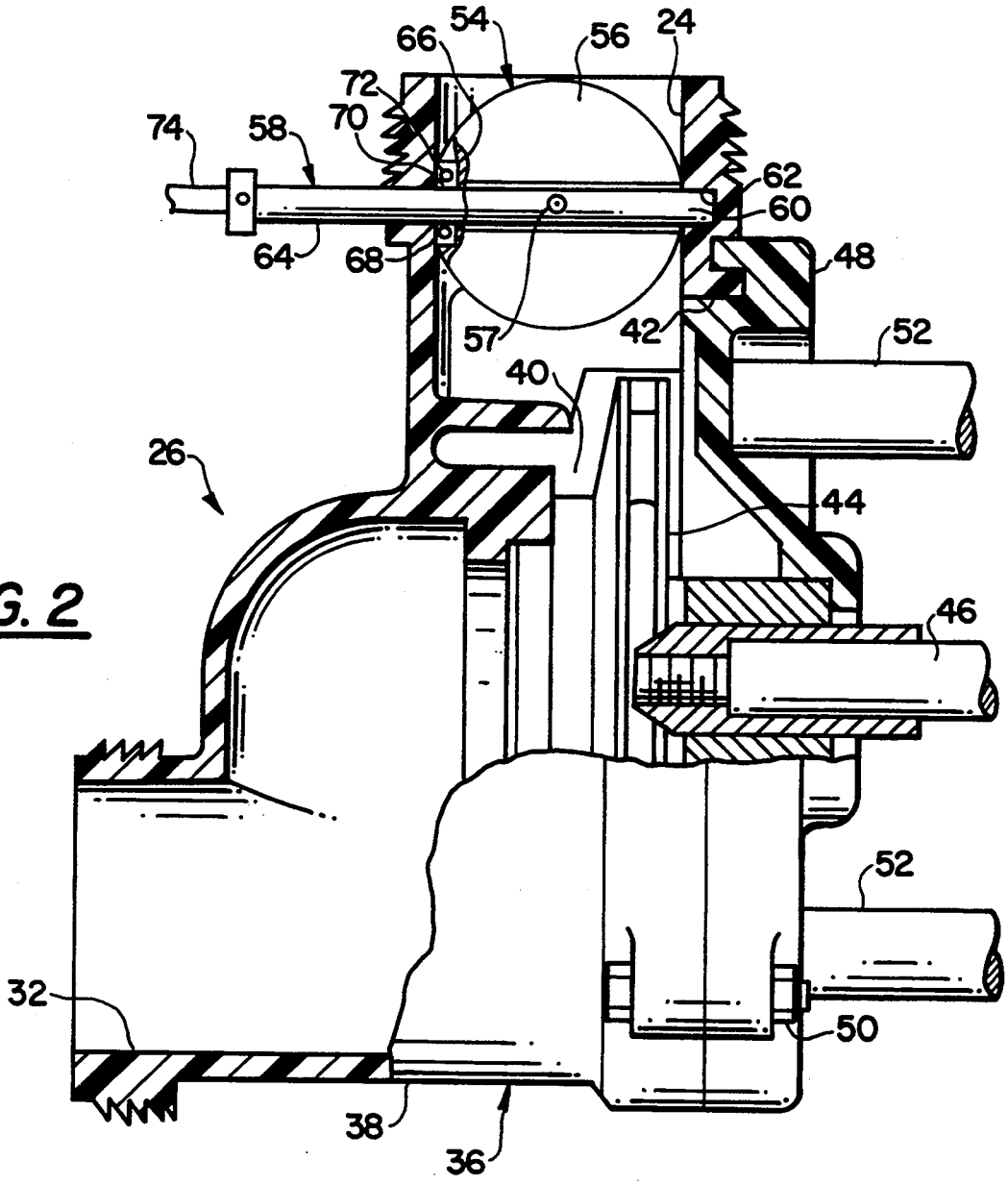
FIG. 2 is a sectional view through the pump shown in FIG. 1 showing the flow-regulating valve means embodying this invention in open position.

As shown in FIG. 2 of the drawings, the pump 26 is substantially conventional in that it has a housing 36 including an integral housing body 38 defining the pump inlet 32, in the form of an exteriorly threaded tubular stub or neck for connection of the return flow pipe 30 thereto, and the outlet 24, also in the form of an exteriorly threaded tubular stub or neck for connection of the piping 22 thereto. The housing body 38 also defines a rotor or impeller chamber 40 having a side opening 42 thereto for reception of an impeller 44 secured to the end of a driving shaft 46 which sealingly extends from the motor 34 through a detachable housing cover 48 for the opening. The cover 48 is secured to the body 38 by bolts 50 and is supported on one end of the motor 34 by supports 52. Although the body 38 is shown as one integral part, it may be made in the form of two or more appropriately connected parts.

The pump outlet 24 conventionally is circular and according to this invention there is rotatably mounted therein a flow-regulating valve in the form of a butterfly valve 54 comprising a valve disc 56 fastened by a pin 57 on an operating shaft 58 having a stub end 60 journalled in a socket 62 in the wall of the outlet and the other end 64 extended oppositely through that wall to the exterior thereof. Where it extends through the wall, the shaft 58 is sealed so as to prevent leakage to the exterior. While such a seal can be effected by any number of ways, the valve disc 56 is circularly enlarged, as at 66, adjacent a flat 68 on the wall, the enlargement provided with an annular groove 70 facing that flat and an O-ring 72 is mounted in that groove for engagement with the flat. The valve 54 may be moved, i.e. rotated, continuously in either direction by the shaft 58 to adjust the position of the valve to regulate flow from the pump 26.

The outer end 64 of the shaft 58 has one end of a flexible cable 74, similar to a speedometer cable, attached thereto for rotating the valve disc 56. The attachment can be made by fixing the cable end in a socket in the shaft end with a set screw, as shown. The other end of the cable 74 extends to a position beneath the lip or rim 16 of the tub 12 where it is fastened to the stem (not shown) of a knob 76. The knob 76 is on the upper side of the rim 16 in a position to be readily accessible to an occupant of the tub 12 without the necessity of getting out of the tub or standing up therein. The stem is rotatably mounted in the lip 16 so that rotation of the knob 76 rotates the valve disc 56 in either direction to adjust the flow to a desired rate.

Surprisingly, it has been found that the foregoing construction eliminates any noise caused by the flow of water through the valve 54 in any of its positions or when the valve is moving between any of these positions. It is believed that this lack of acoustic disturbance arises from the fact that when water flows through the pump outlet 24, which is a part of the pump housing 36, the flow is in such an unstable or turbulent condition that it can be regulated by the valve 54 without creating noise as is the case when a flow regulating valve is mounted in downstream piping connected to the pump outlet.

Still further, it is self-evident that the foregoing construction is far more compact than that wherein a flow regulating valve is located in piping downstream of the pump outlet and separate from the pump housing.

Still further, it is self-evident that the foregoing construction not only is more compact and space saving but also is less expensive than a separate flow regulating valve installed in piping downstream of the pump. Not only is expense lessened but also the foregoing construction is labor saving as contrasted to the installation of a flow regulating valve in downstream piping.

Figure 3:
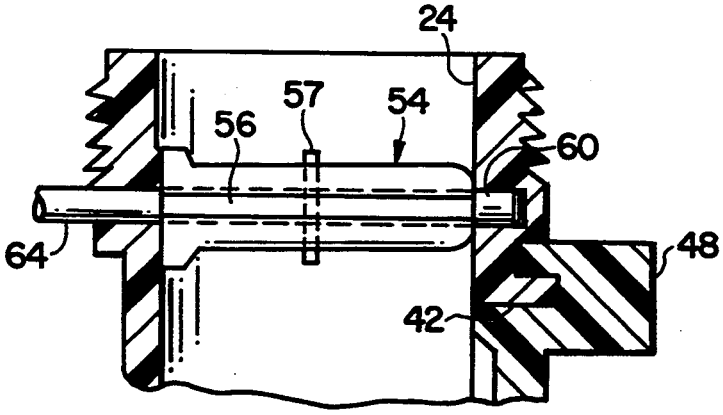
FIG. 3 is a fragmentary view corresponding to FIG. 2 showing the valve means in closed position.
Figure 4:
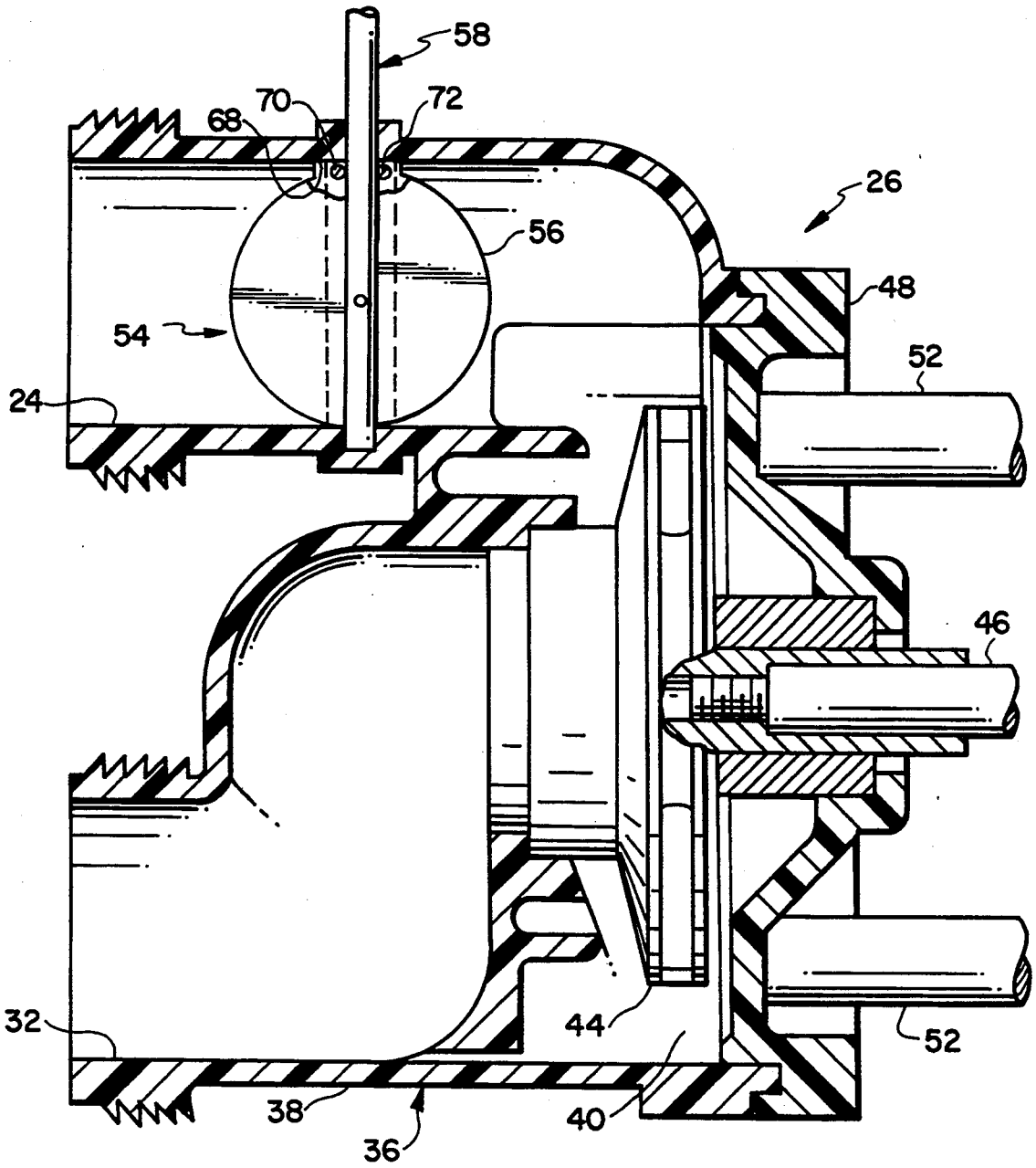
FIG. 4 is a sectional view corresponding to FIG. 2 showing a modification of the invention.

As shown in FIG. 4, there is shown a modification of the invention wherein the pump outlet 24 is substantially parallel to the pump inlet 32 instead of extending generally at right angles thereto as shown in FIG. 3.

While the flexible cable 74, comparable to a speedometer cable, operates satisfactorily to operate the valve 54 with the knob 76, also it has been found that the cable can be replaced satisfactorily with a flexible rod (not shown) made of polycarbonate. In operation, the rod functions substantially the same as a flexible cable.

Figure 5:
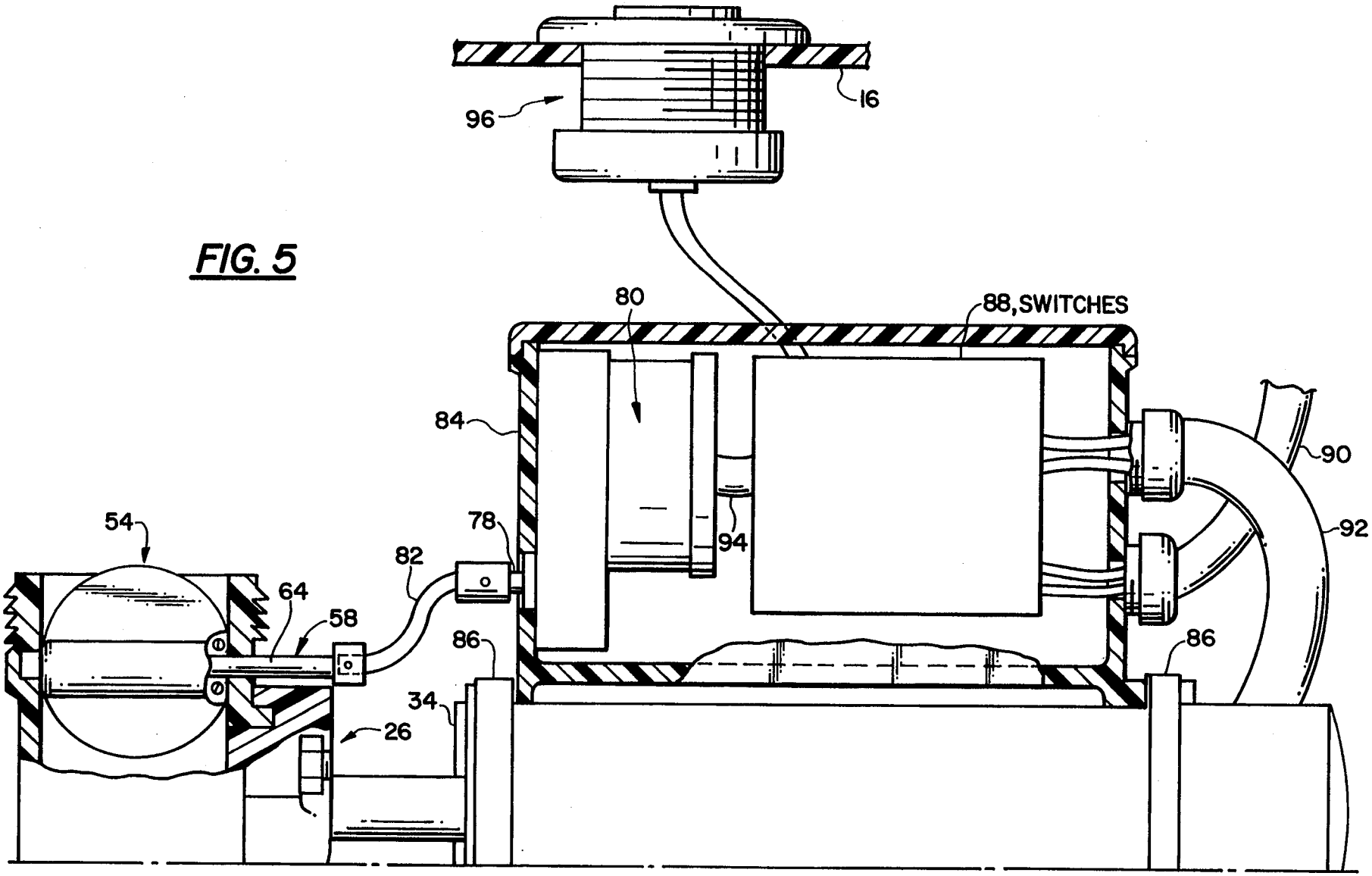
FIG. 5 is a fragmentary view, partly in section, showing a modification of the invention for operating the flow regulating valve.

Instead of substantially manual operation, the valve 54 also can be operated electrically, as shown in FIG. 5, wherein the outer end 64 of the valve shaft 58 is connected to the output shaft 78 of an electric reduction-geared motor 80 by a short flexible cable or rod 82. The motor 80 may be located in a housing 84 secured, as by straps 86, to the pump drive motor 34 to provide a unitary package which includes the pump 26, drive motor 34, flow regulating valve 54, valve motor 80 and electric motor control switches 88 in the housing. The package is powered by an electric cable 90 extending from the switches 88 out of the housing 84 to any appropriate electric power source, e.g. 110 v AC. Electric power cables 92, 94 also extend from the switches 88, respectively, out of the housing 84 to the pump motor 34 and within the housing to the valve motor 80. The switches 88 are controlled by a push button 96 connected to the switches and which may be located conveniently in the lip 16 of the tub 12 where it is readily accessible to an occupant of the tub. When the button 96 is in raised position, the valve motor 80 is disconnected from the cable 90, i.e. from the power source, but in depressed position the motor 80 is connected to the power source. When the button 96 is first pressed down the pump motor 34 is connected to the power cable 90, i.e. the power source, and when released that connection is maintained. When the button 96 is pressed down a second time, the pump motor 34 is disconnected from the power cable 90. While the switches 88, push button 96 and its connection to the switches may be of any suitable type, in actual practice air-operated switches have been used and the push button includes a bellows, or equivalent air-pressurizing device, connected to the switches by a tube.

The operation is as follows:

With the package supplied with electric power through the cable 90, the push button 96 may be pressed. This operates the switches 88 to start both the pump motor 34 and the valve motor 80. When the button 96 is held down, both motors 34 and 80 continue to run and the motor 80 slowly rotates the valve 54 in one direction to any selected adjusted position to regulate the flow as desired. When the button 96 is released, the switches 88 continue to operate the pump motor 34 but stop the valve motor 80 and the latter retains the valve 54 in its attained desired flow-regulating position. When the button 96 is pushed a second time, the switches 88 stop the pump motor 34 and flow from the pump 26. Then when the button 96 is again released the valve 54 is left substantially in its adjusted flow regulating position because the period of depression of the button is so brief that the motor 80 barely moves the valve, if at all. The operation may then be repeated.

It thus will be seen that the objects and advantages of this invention have been fully and effectively achieved. It will be realized, however, that the foregoing specific embodiments have been disclosed only for the purpose of illustrating the principles of this invention and are susceptible of modification without departing from such principle. Accordingly, the invention includes all embodiments encompassed within the spirit and scope of the following claims.

I claim:

1. A combination pump and flow-regulating valve comprising:

a centrifugal liquid pump having housing means defining an impeller chamber, an inlet to said chamber, and an outlet from said chamber, said outlet including a wall portion, said centrifugal liquid pump including an impeller in said chamber for pumping liquid from said inlet to said outlet;

flow-regulating means mounted in said outlet for regulating the flow of liquid therethrough including a valve means mounted therein with a portion of said valve means sealingly extending through the wall of said outlet to the exterior of said housing to define an exterior end of said valve means for adjusting the position of said valve means, said valve means controlling the flow of liquid through said outlet;

an electric flow-control motor having an output shaft;

means operatively connecting the exterior end of said valve means with said output shaft for transmitting rotational motion of said output shaft to the exterior end of said valve means to control the flow of liquid;

switch means for selectively applying electrical power to said flow-control motor for controlling said valve means;

an electric drive motor connected to said pump impeller and also controlled by said switch means; and manually-manipulable means for operating the switch means so as to:

start said pump drive motor, start the flow-control motor to adjust the position of said valve means to regulate the flow as desired, stop the flow-control motor when said valve means is in a desired flow-regulating position while continuing operation of said pump drive motor, and stop said pump drive motor.

2. The apparatus defined in claim 1 wherein the manually-manipulable means is a single push button.

3. The apparatus defined in claim 1 wherein the pump and valve means therein, pump drive motor, flow-control motor, means operatively connecting said valve means with said flow-control motor, and switch means are packaged as a unit.

4. The apparatus defined in claim 1 wherein said valve means comprises a valve disc mounted to an operating shaft having at least one end thereof journalled and sealingly extending through the wall of said outlet.

5. The apparatus defined in claim 1 wherein said connecting means comprises a flexible shaft.

6. A whirlpool bath systems, comprising:

a tub having a rim, side walls, and water nozzles mounted to said walls;

piping exteriorly of said tub for supplying water to said nozzles;

a centrifugal water pump adjacent said tub and having an outlet thereof connected to said piping, said pump having housing means defining said outlet;

a valve means mounted in said outlet for regulating the flow therethrough, said valve means having an end thereof exterior of said housing means;

an electric flow-control motor having an output shaft;

means operatively connecting said output shaft to the exterior end of the valve means;

switch means for controlling said flow-control motor;

manually-manipulable means accessible to an occupant of the tub for operating said switch means;

an electric motor drivingly connected to said pump and also controlled by said switch means;

and wherein said manually-manipulable means is operable so as to:

start said pump drive motor, start the flow-control motor to adjust the position of the valve means to regulate the flow as desired, stop the flow-control motor when said valve means is in a desired flow-regulating position while continuing operation of said pump drive motor, and stop said pump drive motor.

7. The structure defined in claim 6 wherein the manually-manipulable means comprises a single push-button.

8. The apparatus defined in claim 7 wherein the valve means comprises a valve disc mounted to an operating shaft having at least one end thereof journalled and sealingly extending through the wall of the outlet.

9. The apparatus defined in claim 8 wherein said valve disc is continuously rotatable.

10. The apparatus defined in claim 6 wherein said connecting means comprises a flexible shaft.

* * * * *